United States Patent [19]

Huerta

[11] Patent Number: 4,541,623

[45] Date of Patent: Sep. 17, 1985

[54] ALIGNMENT RESTRAINT STATION

[75] Inventor: Jose L. Huerta, Austin, Tex.

[73] Assignee: International Business Machines Corporation, Armonk, N.Y.

[21] Appl. No.: 453,023

[22] Filed: Dec. 27, 1982

[51] Int. Cl.[4] ..... B65H 9/14

[52] U.S. Cl. ..... 271/10; 198/463.5; 271/37; 271/111; 271/229; 271/235; 271/237

[58] Field of Search ..... 271/227, 228, 229, 234, 271/235, 237, 243, 245, 246, 37, 38, 110, 111, 10; 198/474

[56] References Cited

U.S. PATENT DOCUMENTS

| | | | |
|---|---|---|---|
| 2,011,745 | 8/1935 | Wormser | 271/237 |
| 3,720,408 | 3/1973 | Horn | 271/18 R |
| 3,908,986 | 9/1975 | Bleau | 271/246 |
| 3,936,181 | 2/1976 | Hill | 271/227 |
| 3,977,666 | 8/1976 | Suzuki et al. | 271/9 |
| 4,192,498 | 3/1980 | Toto | 271/21 |
| 4,245,833 | 1/1981 | Akerstrom | 271/198 |

FOREIGN PATENT DOCUMENTS

| | | |
|---|---|---|
| 1312305 | 4/1973 | United Kingdom . |
| 1496965 | 1/1978 | United Kingdom . |

OTHER PUBLICATIONS

IBM TDB, R. A. Bielling et al, "Second Sheet Restraint", vol. 23, No. 9, Feb. 1981.

IBM TDB, R. A. Bielling et al, "Sheet Supply Hopper", vol. 23, No. 8, Jan. 1981.

IBM TDB, D. A. Deeds et al, "Envelope Gate", vol. 19, No. 3, Aug. 1976.

IBM TDB, K. A. Lennon et al, "Sheet Positioning Apparatus", vol. 17, No. 10, Mar. 1975.

IBM TDB, R. G. Hart et al, "Document Feed Interrupt", vol. 8, No. 10, Mar. 1966.

IBM TDB, P. Feinstein et al, "Envelope Feeding Mechanism", vol. 19, No. 10, Mar. 1977.

Soviet Inventions Illustrated, Sections P, Q, Week B22, issued Jul. 11, 1979, London, England.

*Primary Examiner*—Bruce H. Stoner, Jr.
*Assistant Examiner*—John A. Carroll
*Attorney, Agent, or Firm*—Andrea P. Bryant

[57] ABSTRACT

An improved alignment/restraint station for interposition in an automatic document feed path is disclosed. A unitary structure including back-up rollers and saw-tooth restraint members is positioned downstream of the document separation station and transverse to the direction of feed. Adjacent either end of the unitary structure are dual purpose edge alignment members. The unitary structure is moveable into and out of position in the feed path and includes guide members for leading a document over the edge alignment members.

5 Claims, 8 Drawing Figures

ALIGNMENT RESTRAINT STATION

CROSS-REFERENCE TO RELATED APPLICATION

U.S. patent application Ser. No. 452,992, now U.S. Pat. No. 4,511,136 issued Apr. 16, 1985, filed concurrently herewith having J. L. Huerta et al as inventors and commonly assigned.

DESCRIPTION

Technical Field

This invention relates to document feeding. In particular, it relates to an alignment and second document restraint station in the feed path.

Background Art

Over the years a multitude of techniques and expedients have been employed to assure proper alignment of documents. Likewise, a wide variety of mechanisms have been used to limit document flow to the feed station. If both functions are offered, they are provided by separately operable devices or by a single element performing in more than one capacity. In a known cut sheet handling attachment for high speed printers, cone rollers are used to drive the left edge of a document against a fixed wall. Paddle wheels have been used to drive the leading edge of a document against fixed stops. It is known to use optical reflective and transmissive sensors as well as various forms of micro-switches to detect document presence at a given position in a transport path.

Known means for restraining the entry of second and subsequent sheets into a transport path include gates interposed in the path. Slanted restraint surfaces are also known.

DISCLOSURE OF THE INVENTION

A compact, reliable structure is disclosed for sensing document position, aligning the document and feeding the document. Front edge alignment, stops function also to detect document position. Sawtoothed edges for restraining second and subsequent documents, as well as means for lifting the foremost document over the alignment stops once proper alignment has occurred are provided in a unitary structure which moves upwardly and downwardly into and out of the document feed path.

BRIEF DECRIPTION OF THE DRAWING

Refer now to the drawing wherein a preferred embodiment of the invention is illustrated, and wherein like reference numerals are used throughout to designate like parts.

BEST MODE FOR CARRYING OUT THE INVENTION

Figure 1:
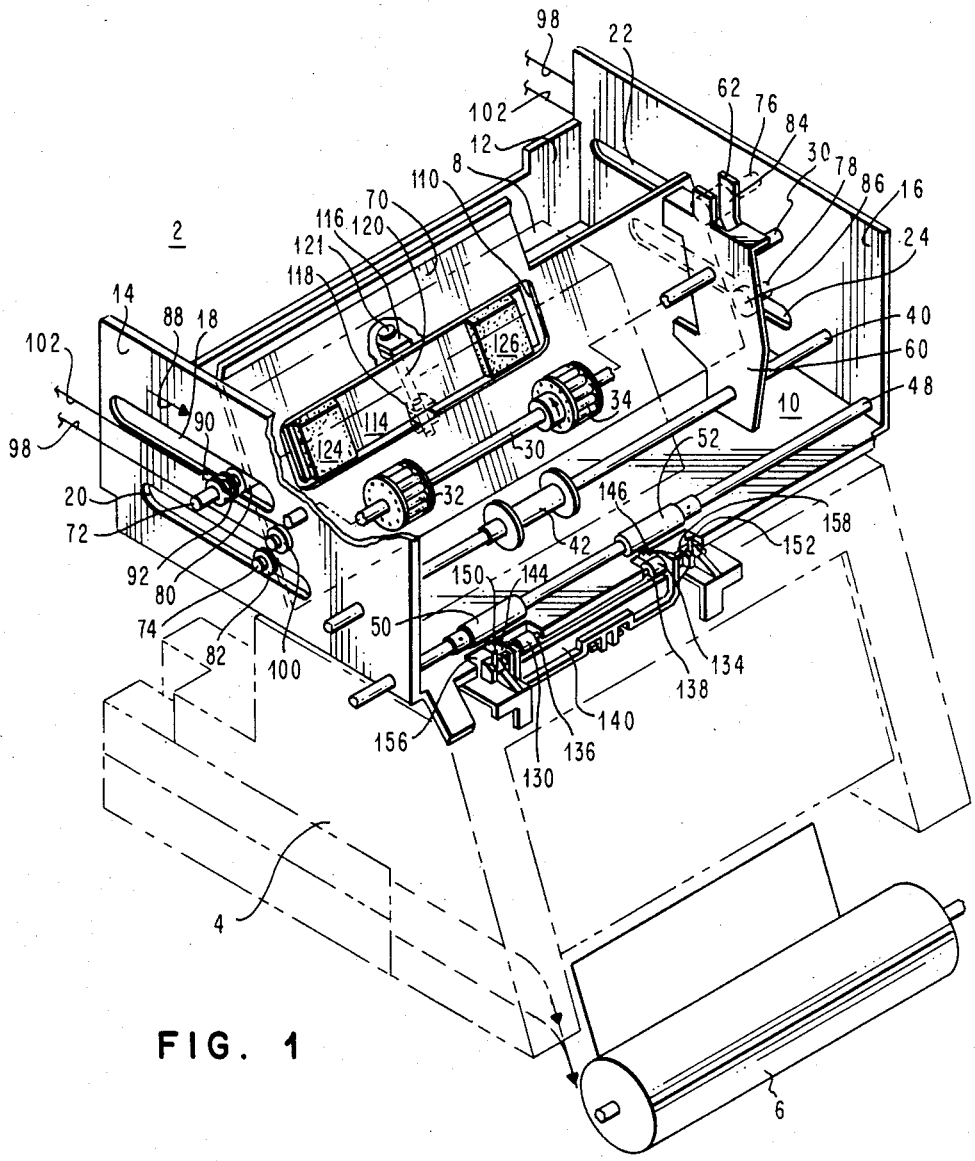
FIG. 1 is the perspective view of an envelope handling apparatus including the present invention.

Refer now to FIG. 1. The envelope handling device of the present invention is indicated generally at 2, placed on top of a cut sheet handler indicated in phantom at 4 so that each may supply documents to a common path to platen 6 of the printer, not shown.

Envelope device 2 includes a hopper holding a stack 8 of envelopes comprised of base 10, fixed rear wall 12 and slotted side walls 14 and 16. Side wall 14 has slots 18 and 20 for purposes which will become clear as the description proceeds. Similarly, side wall 16 has parallel slots 22 and 24 which are aligned with those in side wall 14. Shaft 30 is rotatably mounted in side walls 14 and 16. Fixedly mounted on shaft 30 for rotation therewith are separator shingler rollers 32 and 34 of the ferris wheel type. A DC motor (not shown) is provided for driving shaft 30.

Also mounted across envelope handling device 2 in side walls 14 and 16 is rod 40. Rotatably secured to rod 40 is idler roller 42. Roller 42 is provided for constraining envelope stack 8 and enhances the concavity of the foremost envelope in the stack when it is being shingled forward. A shaft 48 is rotatably mounted downstream of rod 40 in side walls 14 and 16. Feed rollers 52 and 50, fixedly mounted on shaft 48, are driven through a belt and pulley linkage (not shown) by platen 6.

The actual size of the envelope storage area within envelope handling device 2 is adjustable in accordance with the width and depth of the envelope stack 8 to be fed. Storage area width is adjustable by means of side guide 60. Lever 62 which is provided for releasing and locking the position of side guide 60 will be discussed in detail having reference to FIG. 3. Side guide 60 is slidably mounted on shaft 30 and rod 40.

Self-adjusting, movable pressure plate 70 which supports the rear of stack 8 is inclined at 55° to the horizontal base 10, measured from the direction of rear wall 12, of envelope handling device 2. This position enhances the separation of the foremost envelopes prior to the beginning of the mechanical separation cycle because some of the envelopes are already separated. Maintaining stack 8 at such an angle also magnifies the action of separation by providing more discrimination between the first and second envelope.

Pressure plate 70 includes four studs, two on either side, 72 and 74 on the left and 76 and 78 on the right, upon which are mounted four rollers having soft rolling surfaces. Rollers 80 and 82 are on studs 72 and 74; rollers 84 and 86, on studs 76 and 78. Studs 72, 74, 76 and 78 extend through the four parallel slots, 18, 20, 22 and 24, located in envelope device side walls 14 and 16, respectively.

Each of studs 72 and 76 is additionally provided with two cable connector clips for anchoring cables used to control the position of pressure plate 70 as it is urged in the direction of arrow 88. Stud 72 has clips 90 and 92 while stud 76 has attached thereto clips (not shown here). Cable 98 is connected to clips 92 and 94 over pulley 100 mounted on side wall 14. Cable 102 is connected to clip 90 and another, not shown, and trained over a pulley mounted on side wall 16. Cables 98 and 102 are trained over a system of pulleys, which with appropriate spring means are provided for urging pressure plate 70 toward separator shingler rollers 32 and 34. A more detailed description of the apparatus for urging pressure plate 70 appears in co-pending application Ser. No. 452,992.

Pressure plate 70 includes an opening 110, corresponding in size and shape, for accommodating pivot plate 114 which is pivotally mounted by means of brackets 116 and 118 to pressure plate 70. Pivot plate 114 moves about an axis 121 through the center of rod 120. Opening 110 and pivot plate 114 located therein are positioned within pressure plate 70 so as to align pivot plate 114 with separator shingler rollers 32 and 34. In particular, resilient pads 124 and 126, located at either end of pivot plate 114, are aligned with shingler rollers 32 and 34, respectively.

Positioned directly beneath portions of feed rollers 52 and 50 are back-up rollers 130 and 134. These rollers 130, 134 are axially parallel to feed rollers 50,52 but are shorter in length. Back-up rollers 130 and 134 are rotatably mounted on studs 136 and 138, respectively, located at either end of bracket 140. Made integral with bracket 140, at either end thereof adjacent back-up rollers 130 and 134, are two sawtooth restraint edges 144 and 146.

Two micro-switches 150 and 152 for aligning and sensing the leading edge of an envelope from stack 8 are provided in appropriately shaped openings 156 and 158 in base 10. Openings 156 and 158 accommodate the micro-switches 150 and 152 which perform a dual function which will be described in greater detail having reference to FIG. 5, as well as sawtooth restraining edges 144 and 146, and back-up rollers 130 and 134. The entire restraint alignment function which occurs in the envelope path at a position beneath feed rollers 52 and 50 is more fully described and claimed in co-pending, commonly assigned U.S. patent application Ser. No. 452,992.

Figure 2:
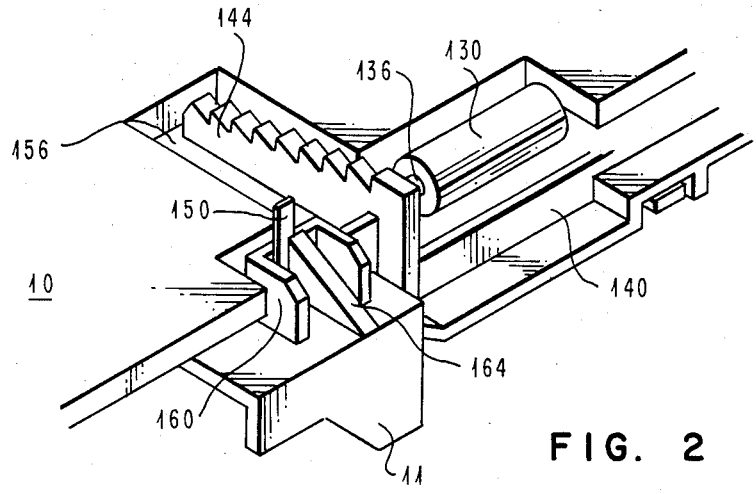
FIG. 2 is a close-up view of one of the two alignment restraint subassemblies.

FIG. 2 is a close-up view of the side of the alignment restraint station beneath feed roller 50 in FIG. 1. Bracket 140 is a unitary structure including the studs holding back-up rollers 130 and 134 and at either end the sawtooth restraint edges 144 and 146 and envelope lifter portions 160 and 162. Means, not shown, are provided for lifting bracket 140 and its associated portions just mentioned above the plane of hopper base 10 so that once an envelope separated from stack 8 (FIGS. 1 and 3) makes micro-switch 150 and its corresponding switch at the other end (shown in FIG. 1) the bracket 140 is raised so that lifter portion 160 enables the envelope to be fed over the projecting lever 150 of the micro-switch.

Figure 3:
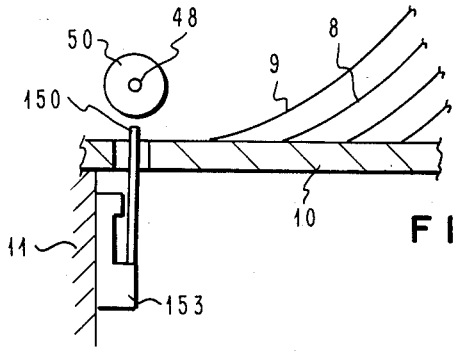
FIGS. 3 through 6 are cross-sectional views illustrating sequentially the relative positions of the components of the alignment restraint station.

FIG. 3 shows the condition of the aligner restraint mechanism of the present invention just as envelope stack 8 is subjected to shingling. The foremost envelope has not yet reached micro-switch lever 150. Micro-switch lever 150 has its bottom section 153 fixedly attached to vertical support 11 of envelope apparatus 2.

Figure 4:
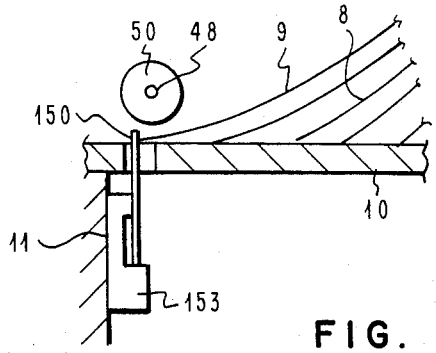

FIG. 4 shows the position of foremost envelope 9 after it has contacted micro-switch lever 150 and caused it to bottom out on portion 164 of support 11 as well as bottom section 153 of the micro-switch. When envelope 9 contacts micro-switch 150, the envelope has passed beneath the center line of friction driven feed roller 50 on shaft 48 which, it will be recalled, is drivingly connected to platen 6 of the high speed printer that the envelope handling apparatus to which the present invention is attached.

Though only one is shown in FIGS. 2 through 7, it will be recalled from FIG. 1 that two mechanical micro-switches are provided on base 10, one at either end and they protrude through openings 156 and 158 in base 10 (FIG. 1). The two switches 150 and 152 are electrically connected in series and serve as mechanical stops when envelope 9 reaches the sense point beneath feed rollers 50 and 52 and insure that envelope 9 will be straight and non-skewed. Both switches 150 and 152 must make before shingling stops, that is, the DC motor (not shown) stops driving shingler rollers 32 and 34 on shaft 30 (FIG. 1).

Figure 5:
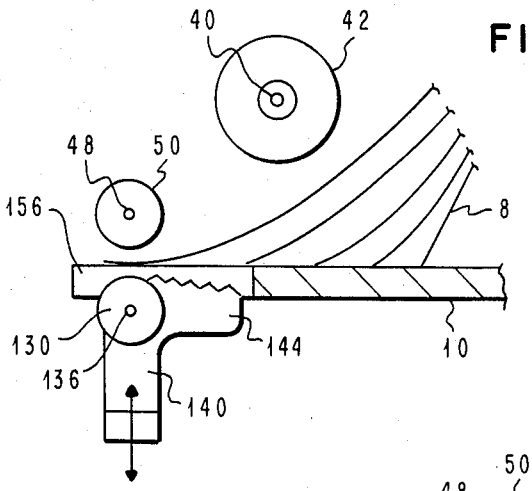

In FIG. 5 switches 150 and 152 have made and bracket 140 is still in its lowered position just as shingling stops.

Figure 6:
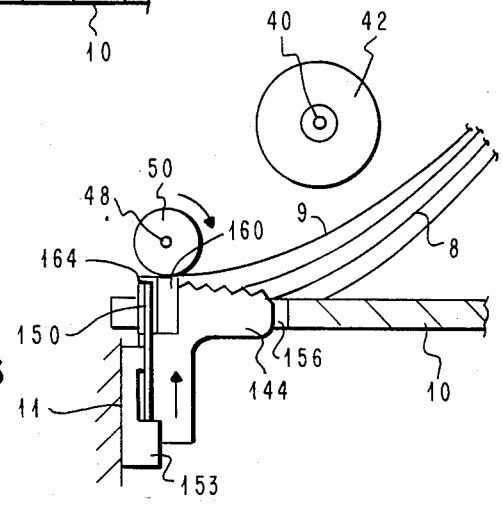

In FIG. 6 in the next sequential step is illustrated. Shaft 48 which is drivingly connected to platen 6 is driven so that friction feed roller 50 begins to rotate clockwise, as shown. Envelope 9, the foremost envelope, is caught beneath feed roller 50, however, subsequent envelopes have their leading edges engaged in the sawtooth edges of molded second document restraint edge 144. At the same time as illustrated in FIG. 6, the envelope edge lifter 160 on support 11, which can be more clearly seen in FIG. 2, is raised along with bracket 140 so that the foremost envelope 9 is pinched between feed roller 50 and backup roller 130. Micro-switch levers 150 and 152 are fixedly attached to vertical support 11 beneath base 10 of envelope handling apparatus 2 and thus do not move into and out of the feed path with bracket 140.

Figure 7:
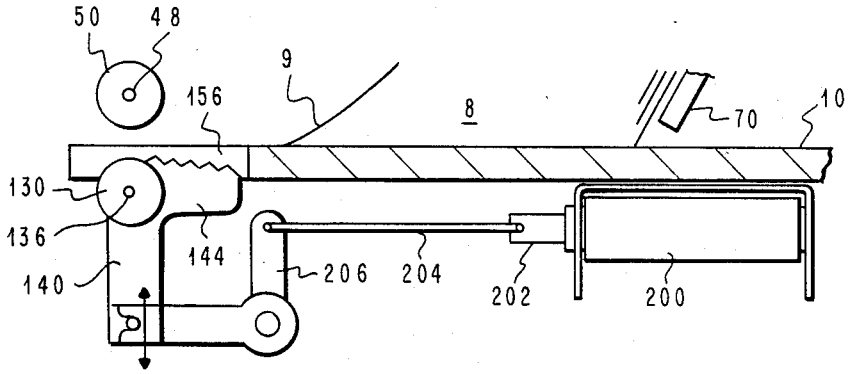
FIG. 7 is a cross-sectional view through envelope apparatus 2 during a separation feed cycle.

FIG. 7 shows the apparatus for selectively raising and lowering bracket 140. Solenoid 200 has a plunger 202 connected to bellcrank 206 with link 204 for vertically actuating bracket 140. This arrangement is shown for illustration purposes only and those skilled in the art will appreciate that other mechanisms may be employed to perform this function.

Figure 8:
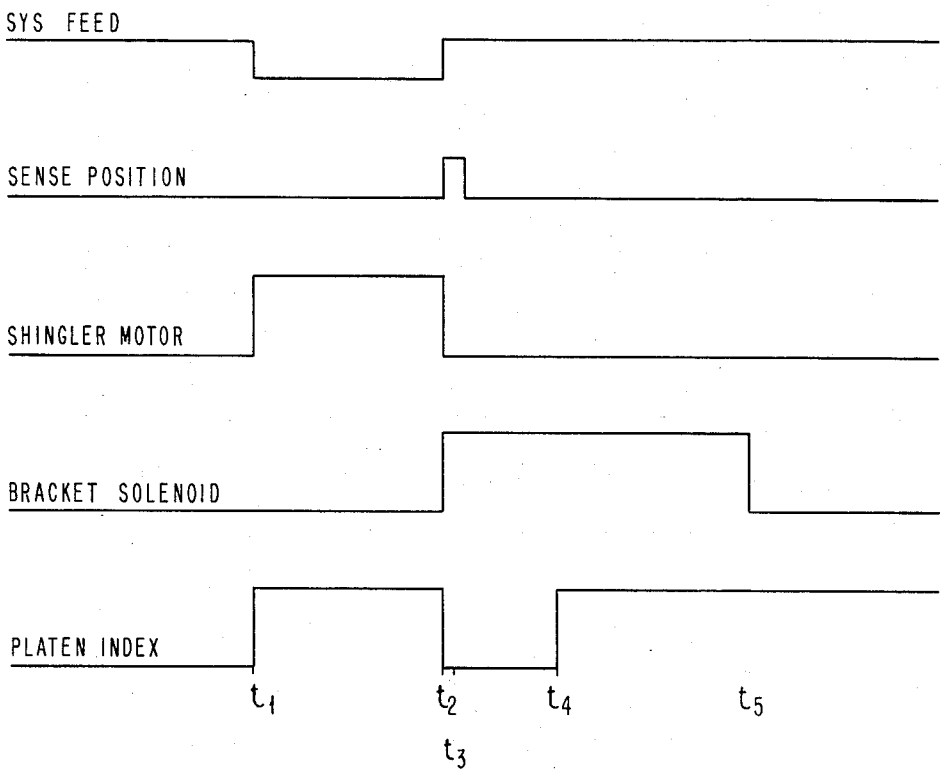
FIG. 8 is a timing chart illustrating the operation of an envelope handling system in which the present invention is embodied.

FIG. 8 is the timing chart illustrating envelope separation and feed cycle start. At time t1, the using system feed signal goes down. Simultaneously, the DC motor provided for driving shingler rollers 32 and 34 is energized, that is the voltage for energizing the motor goes up and the connection is made between the platen 6 for driving friction feed rollers 50 and 52. At time t2, the sense position signal goes up in response to the making of micro-switches 150 and 152, and the printer feed signal goes up again. Simultaneously, the voltage energizing the shingler wheels 32 and 34 goes down. Simultaneously still, solenoid 200 is energized to raise bracket 140 and the printer platen index connection to friction feed rollers 50 and 52 is broken. At time t3, the sense position signal goes down because the foremost envelope edge has been lifted by the lifters to clear the micro-switch levers and allowed the micro-switches to restore.

After a delay of predetermined duration to assure that bracket 140 has completely reached its upward position, the connection is again made at t4 between shaft 48 bearing friction drive rollers 50 and 52 and printer platen 6 so that an envelope is fed between friction feed rollers 50 and 52 and back-up rollers 130 and 134 into the transport path to the print station (not shown) adjacent platen 6.

The present invention is described in conjunction with an envelope handling attachment for use with a cut sheet feeder with a high speed printer such as those used in word processing systems or the like. With obvious modifications, such an envelope handling device may be used directly with a printer. While the invention has been particularly shown and described with reference to a preferred embodiment, it will be understood by those skilled in the art that the above mentioned modifications and various other changes in form and detail may be made without departing from the spirit and scope of the invention.

I claim:

1. Improved apparatus for aligning the leading edge of a first document to be fed at a feed station, including a plurality of feed rollers, and restraining second and subsequent documents to be fed comprising:

means for urging said documents to the feed station;

a pair of stationary stops arranged transversely of the feed path direction for engaging the leading edge of the document;

a bracket member located between said pair of stationary stops and adapted to be selectively moved into and out of the feed path;

a pair of lifting means, located at each end of the bracket member and actuable in response to a signal developed by the pair of stops, for lifting the leading edge of the document over the stops;

second and subsequent document restraining means connected to and symmetrically positioned adjacent said lifting means comprising guide means located beneath the stationary stops; and a pair of rotatably mounted backup rollers on the bracket member, and arranged symmetrically with respect to the lifting means and restraining means and positioned to cooperate with the feed rollers.

2. The apparatus of claim 1 wherein said second and subsequent document restraining means comprises a pair of serrated edges.

3. The apparatus of claims 1 or 2 wherein said pair of stationary stops comprises a pair of microswitches connected in series and adapted to disable said means for urging when the switches are made.

4. Improved envelope handling apparatus for providing envelopes seriatim to a printer from a stack of envelopes comprising:

shingler means located upstream of the entry to an envelope feed path for separating the foremost envelopes from the stack and urging them toward the entry;

a pair of stationary barrier means located at the entry to the envelope feed path for detecting the presence of and aligning the leading edge of the foremost envelope;

a plurality of selectively rotatable feed rollers located above the stationary barrier means;

a movable bracket member located beneath the feed rollers at the entry to the feed path including integral envelope lifting means and second and subsequent envelope restraining means, said restraining means comprising serrated edges;

backup rollers arranged symmetrically with respect to said envelope lifting means and said restraining means on said bracket member and positioned to cooperate with the feed rollers; and means for selectively raising the bracket member for nipping the foremost envelope between the feed and backup rollers for feeding to the printer.

5. The apparatus of claim 4 additionally comprising means connecting the shingler means and the pair of stationary barrier means and adapted for deactivating the shingler means when the pair of stationary barrier means detect the leading edge of the foremost envelope.

* * * * *